US007213583B2

(12) United States Patent
Mills

(10) Patent No.: US 7,213,583 B2
(45) Date of Patent: May 8, 2007

(54) SMALL ENGINE FUEL TANK WITH INTEGRATED EVAPORATIVE CONTROLS

(75) Inventor: Vaughn K. Mills, Chelsea, MI (US)

(73) Assignee: Eaton Corporation, Cleveland, OH (US)

( * ) Notice: Subject to any disclaimer, the term of this patent is extended or adjusted under 35 U.S.C. 154(b) by 203 days.

(21) Appl. No.: 10/874,897

(22) Filed: Jun. 23, 2004

(65) Prior Publication Data

US 2005/0284450 A1 Dec. 29, 2005

(51) Int. Cl.
*F02M 55/02* (2006.01)

(52) U.S. Cl. ..... 123/518; 123/519

(58) Field of Classification Search ..... 123/516, 123/518, 519, 520
See application file for complete search history.

(56) References Cited

U.S. PATENT DOCUMENTS 3,372,679 A * 3/1968 Aitken ..... 123/519
3,757,753 A * 9/1973 Hunt ..... 123/519
4,028,075 A 6/1977 Roberge
4,852,761 A * 8/1989 Turner et al. ..... 220/746
4,919,103 A * 4/1990 Ishiguro et al. ..... 123/514
5,687,778 A * 11/1997 Harris ..... 141/59
5,901,689 A * 5/1999 Kimura et al. ..... 123/518
6,105,708 A * 8/2000 Amano et al. ..... 180/309
6,182,693 B1 * 2/2001 Stack et al. ..... 137/565.17
6,302,137 B1 * 10/2001 Devall ..... 137/202
6,508,263 B1 * 1/2003 Jahnke et al. ..... 137/202
2003/0089405 A1 * 5/2003 Mills ..... 137/587
2003/0140970 A1 * 7/2003 Benjey ..... 137/587
2003/0205272 A1 * 11/2003 Benjey et al. ..... 137/202
2005/0178368 A1 8/2005 Donahue
2005/0274364 A1 * 12/2005 Kirk et al. ..... 123/519

* cited by examiner

*Primary Examiner*—Thomas Moulis
(74) *Attorney, Agent, or Firm*—Anna M. Shih; Roger A. Johnston

(57) ABSTRACT

A fuel tank assembly for small engines having a vapor storage canister disposed within the tank in the vapor dome with an atmospheric vent line to the canister through the tank wall and a canister vapor outlet line also through the tank wall. A fuel vapor vent valve is disposed in the vapor dome of the tank with the vent valve outlet connected to the canister inlet. A fuel filler tube extends through the tank wall to a desired depth to prevent vapor from escaping through the filler tube when the fuel level rises to the lower end of the filler tube and alerts the operator by rapid rise of fuel in the filler tube.

16 Claims, 2 Drawing Sheets

SMALL ENGINE FUEL TANK WITH INTEGRATED EVAPORATIVE CONTROLS

BACKGROUND OF THE INVENTION

The present invention relates to fuel tanks for small engines such as those employed in portable power equipment as, for example, lawn mowers and portable generator sets. Recent regulations for controlling the emission of fuel vapors have required installation of vapor storage devices to prevent escape of fuel vapors through the engine air inlet during periods when the engine is not operating and provide for purging when the engine is running. This recently imposed requirement on small engine manufacturers has created problems in installing the engines in the equipment in which they are to be used inasmuch as the equipment manufacturer commonly purchases the engine and fuel tank for installation as a subassembly during final assembly of the engine operated equipment. Thus, for the aforesaid equipment applications the burden of providing for fuel vapor emission control has been imposed upon the small engine manufacturer and has created problems in the design and installation of the tank and fuel system for the small engines.

In particular, the requirement for a vapor storage device has been found to create problems in mounting the tank and fuel system on a small engine as a prepackaged subassembly; and, has added additional costs in providing for the storage device and the mounting and vapor conduit interconnections between the storage device and the tank. Thus, it has been desired to provide a way or means of controlling fuel vapor emissions from a small engine tank installation in a manner which is self-contained and low in cost.

BRIEF SUMMARY OF THE INVENTION

The present invention provides a small engine fuel tank with integral fuel evaporative controls including a storage canister and rollover valve disposed within the tank in a manner which provides adequate control of fuel vapor emissions during periods of engine inoperation, permits purging during engine operation and thus simplifies the mounting of the fuel vapor emission devices on the engine.

DETAILED DESCRIPTION OF THE INVENTION

Figure 1:
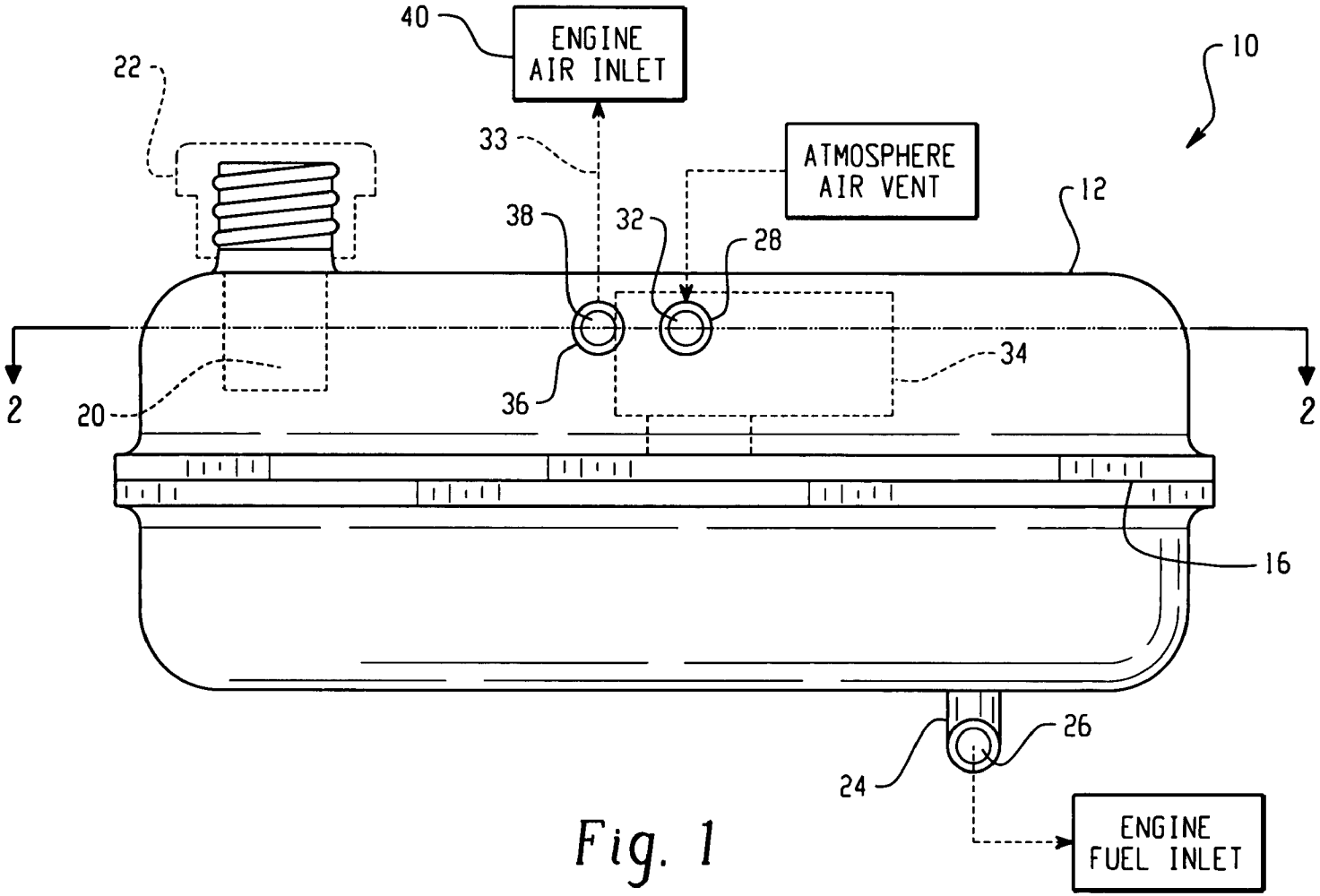
FIG. 1 is a side view of a small engine fuel tank of the type intended for gravity fuel feed to the engine.

Referring to the drawings, the fuel tank assembly of the present invention is indicated generally at 10 and includes a tank 12 having wall structure 14 which may be formed conveniently by weldment about a mid-seam 16 in any manner well known in the art as, for example, by metallic or non-metallic welding as the case may be for the particular material employed for the tank.

The upper wall 18 of the tank has provided therein a filler tube 20 which may be integrally formed with the upper wall 18 and which is adapted for receiving thereover a closure cap 22 indicated in dashed outline in FIG. 1. The tube 20 extends downwardly into the interior of the tank to a desired depth for creating a vapor dome in the region beneath the upper wall 18 when the liquid level in the tank has risen to cover the lower end of tube 20.

Tank 12 has a fuel feed outlet fitting 24 provided through the lower wall on the lower wall thereof with a fuel feed passage 26 formed therein for gravity feed of fuel. It will be understood that fitting 24 is adapted for connection to a fuel line (not shown) for connection to the engine fuel inlet. It will be understood that the feed passage may be disposed at other locations of the tank wall structure, for example, the upper wall 18 in small engines employing a fuel pump.

Tank 12 has a fitting 28 extending from the upper portion of the sidewall 30 and which has a vapor purge passage 32 formed therein. With reference to FIG. 1, the passage 32 is an atmospheric air inlet.

Figure 2:
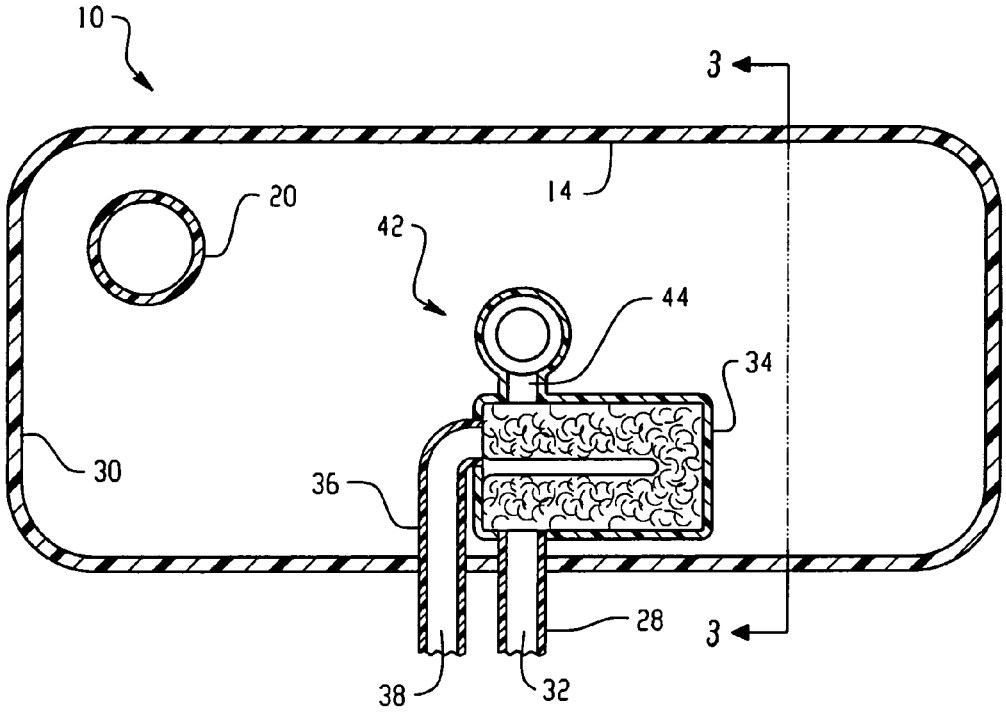
FIG. 2 is a section view taken along section indicating lines 2—2 of FIG. 1; and, FIG. 3 is a section view taken along section indicating lines 3—3 of FIG. 2.
Figure 3:
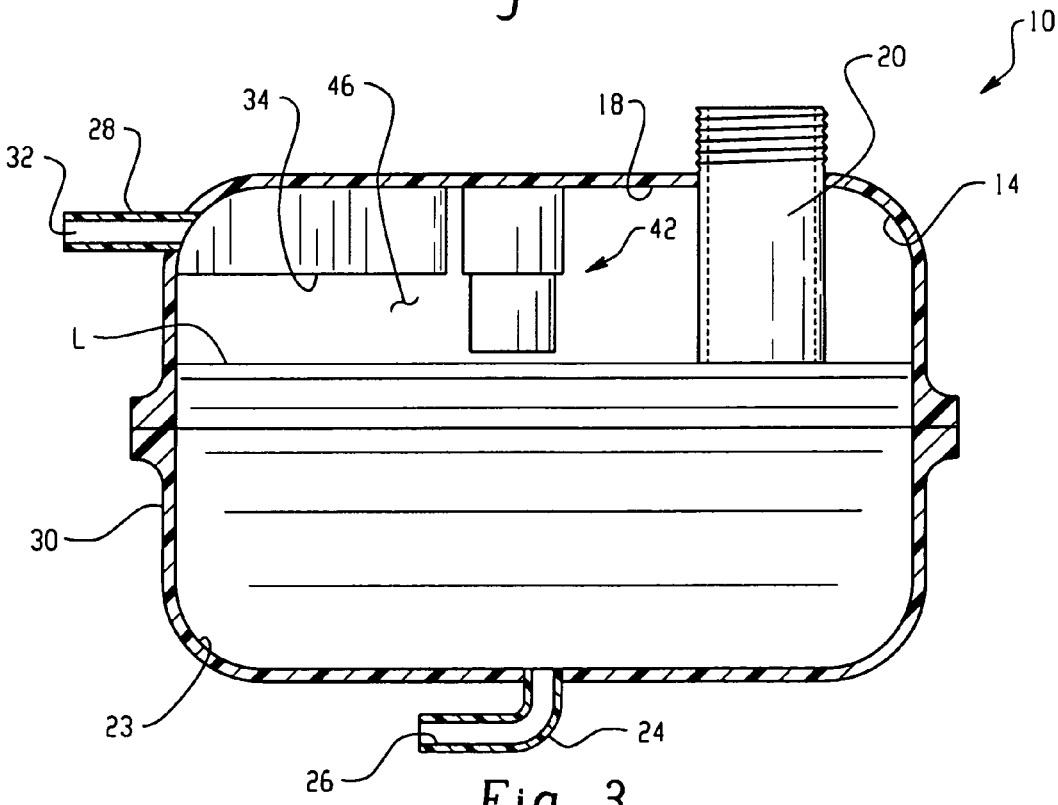

Inlet 32 communicates through the tank wall and to the interior of a vapor storage canister 34 which is disposed within the tank and preferably attached to the inside of the top wall 18 of the tank as shown in FIGS. 2 and 3. It will be understood that the canister 34 may contain any suitable adsorbent such as, for example, granulated charcoal material.

The canister 34 also has connected thereto a fitting 36 which has vapor outlet passage 38 formed therein and which extends outwardly through the side 30 of the tank to the exterior of the tank. With reference to FIG. 1, passage 38 communicates through a conduit 33 shown in dashed outline to the air inlet 40 of the vehicle engine.

Referring to FIGS. 2 and 3, a float operated vent valve indicated generally at 42 is disposed within the tank and preferably adjacent the inside surface of the upper wall 18 of the tank. Valve 42 has the vapor outlet passage 44 thereof communicating with the interior of the canister 34 as shown in FIG. 2. It will be understood that the valve 42 may either be attached to the side of the canister or the undersurface of the upper wall 18 of the tank. In the present practice of the invention, the vapor vent valve 42 is float operated as is known in the art.

Referring to FIGS. 2 and 3, the filler tube 20 is disposed through the tank wall with the lower end of tube 20 located or positioned at a desired level of liquid fuel fill such that, upon the liquid level reaching the lower end of the tube, the vapor dome above the liquid fuel is isolated from the filler tube and vapor can no longer escape through the filler tube. Accordingly, if the rate of fill is sufficient such that the vapor cannot escape rapidly enough through the vent valve 42, the liquid fuel rises quickly in the filler tube alerting the operator that the tank is at the desired level of fill. This arrangement thus maintains a vapor dome in the fuel level above the tank and prevents slugging of liquid fuel into the vent valve 42 and the canister.

The surface of the liquid fuel at the level of the lower end of the filler tube 20 is denoted by the reference character L in FIG. 3. It will be understood that the region of the tank bordered by the wall structure thereof above the level L comprises a vapor dome as denoted by reference numeral 46.

In the present practice of the invention, the filler tube 20 is shown as disposed through the upper wall 18 of the tank; however, it will be understood that the filler tube may be also located through the sidewall 30 if desired.

The present invention thus provides an integrated fuel vapor storage and vapor flow control system for a fuel tank of the type employed for small engines whereupon the tank may be located in close proximity to the engine or in certain applications mounted directly to the engine for modular assembly to the equipment in which the engine is employed.

The present invention thus enables implementation of fuel evaporative control on a small engine with only a change in the fuel tank and does not require the addition of other related components to the engine assembly.

Although the invention has hereinabove been described with respect to the illustrated embodiments, it will be understood that the invention is capable of modification and variation and is limited only by the following claims.

What is claimed is:

1. A fuel tank assembly for small engines comprising:

(a) a small engine fuel tank having an upper portion of the tank defining a vapor dome above a fuel level;

(b) a vapor storage device disposed within the tank in the vapor dome and having a vapor inlet; and, (c) a float valve disposed within the tank and having an inlet communicating with the vapor dome and an outlet communicating with the vapor inlet of the vapor storage device.

2. The assembly defined in claim 1, wherein the float valve is attached to the upper portion of the tank.

3. The assembly defined in claim 1, wherein the vapor storage device is attached to the upper portion of the tank.

4. The assembly defined in claim 1, wherein the tank has a fuel feed outlet disposed in a lower region of the tank for fuel feeding.

5. A method of making a fuel tank assembly for small engines comprising:

(a) forming a small engine fuel tank having a vapor dome region;

(b) disposing a vapor storage device within the tank In the region of the vapor dome; and, (c) disposing a float valve in the vapor dome region and connecting the outlet of the valve to the vapor storage device.

6. The method defined in claim 5, wherein the step of disposing the vapor storage device includes attaching the vapor storage device to an upper portion of the tank.

7. The method defined in claim 5, wherein the step of disposing a float valve includes attaching the float valve to an upper portion of the tank.

8. The method defined in claim 5, wherein the step of forming a tank includes forming a fuel outlet in the bottom of the tank for fuel feeding.

9. The method defined in claim 5, further comprising the step of connecting a conduit for communicating through the sidewall of the tank to vent the vapor storage device to the atmosphere.

10. The method defined in claim 5, further comprising the step of connecting a conduit acting as a storage device purge outlet to the vapor storage device and through the tank.

11. A fuel tank assembly for small engines comprising:

a small engine fuel tank having an upper region defining a vapor dome above a fuel level;

a vapor storage device having a vapor inlet, an atmospheric air inlet that communicates through the tank to outside the tank, and a vapor purge outlet that communicates through the tank to outside the tank; and a float valve, wherein at least one of the vapor storage device and the float valve attached to the upper region within the tank.

12. The assembly defined in claim 11, wherein the vapor storage device and the float valve are both attached to the upper region within the tank.

13. The assembly of claim 11 further comprising:

a first conduit connected to the atmosphere air inlet and extending through the tank; and a second conduit connected to the vapor purge outlet and extending through the tank.

14. The assembly of claim 11, further comprising a fuel feed outlet disposed in a lower region of the fuel tank for fuel feeding.

15. The assembly of claim 1, wherein the vapor storage device includes:

a vapor inlet;

an atmospheric air inlet that communicates through the tank to outside the tank; and a vapor purge outlet that communicates through the tank to outside the tank.

16. The assembly of claim 15, further comprising:

a first conduit connected to the atmosphere air inlet and extending through the tank; and a second conduit connected to the vapor purge outlet and extending through the tank.

* * * * *